United States Patent [19]

Goodrode

[11] 4,225,203

[45] Sep. 30, 1980

[54] ENERGY SAVING INNER DOOR DEVICE FOR A REFRIGERATION APPLIANCE

[76] Inventor: Melvin H. Goodrode, 55 Glen Eyrie Ave., San Jose, Calif. 95125

[21] Appl. No.: 937,948

[22] Filed: Aug. 30, 1978

[51] Int. Cl.[2] ..... A47B 97/00; A47F 3/04

[52] U.S. Cl. ..... 312/236; 312/291

[58] Field of Search ..... 312/116, 291, 138 R, 312/236; 62/265; 292/251.5, 17

[56] References Cited

U.S. PATENT DOCUMENTS

| | | | |
|---|---|---|---|
| 1,741,039 | 12/1929 | Schaefer et al. | 292/17 |
| 2,051,733 | 8/1936 | Moore et al. | 62/265 |
| 2,062,856 | 12/1936 | Armbruster | 312/291 |
| 2,124,857 | 7/1938 | Mac-Grath | 312/291 |
| 2,233,394 | 3/1941 | Asbaugh | 312/291 |
| 2,381,598 | 8/1945 | Jones | 312/291 |
| 3,468,576 | 9/1969 | Beyer et al. | 292/251.5 |

FOREIGN PATENT DOCUMENTS

| | | | |
|---|---|---|---|
| 135323 | 11/1949 | Australia | 312/291 |
| 1128862 | 1/1957 | France | 312/291 |

*Primary Examiner*—Ramon S. Britts
*Assistant Examiner*—Alexander Grosz
*Attorney, Agent, or Firm*—Paul L. Hickman

[57] ABSTRACT

An energy saving inner door device for inhibiting the loss of cold air from a refrigerator when the refrigerator's outer door is opened, the device including a panel pivotally or hingedly attached to the inside of the refrigerator for closing off the volume of space between two adjacent refrigerator shelves. The panel can be pivoted between an upright position to close off the volume of space between the pair of shelves and thus trap the cold air therebetween, and a lowered position that allows the perishables stored on the lower one of the pair of shelves to be accessed. A latch is provided to hold the panel in the closed position and knobs are provided to facilitate the opening and closing of the panel.

3 Claims, 5 Drawing Figures

ENERGY SAVING INNER DOOR DEVICE FOR A REFRIGERATION APPLIANCE

BACKGROUND OF THE INVENTION

1. Field of the Invention

This invention relates generally to energy saving devices and more particularly to energy saving devices designed to preserve the refrigerated air within a refrigeration appliance.

2. Description of the Prior Art

Refrigeration appliances, such as refrigerators, freezers and ice chests, are useful and convenient machines for prolonging the usable lifetime of foodstuffs and other perishables. In fact, the common upright-type refrigerator found in virtually every household is considered to be almost a necessity by most persons living in today's society.

A problem with upright refrigerators (as well as freezers and iceboxes) is that when the door of the refrigerator is opened the cold, heavy air within the refrigerator quickly flows out and disperses into the ambient environment. In view of the fact that an average household refrigerator is opened many times during a typical day, the amount of cold air "spillage" can be quite significant. Since it takes energy to replace the cold air that was lost, it will be appreciated that cold air "spillage" is quite wasteful of both energy and money.

A design for refrigeration appliances that minimizes cold air spillage is the well known chest-style refrigeration appliance. The chest design or style of refrigeration appliance basically includes a rectangular, box-like container within which perishables are stored and a lid for closing the open top of the container. Since refrigerated air is denser and therefore heavier than room temperature air, it will not flow out of the container of the chest-style refrigeration appliance when the lid is opened.

A problem with chest-style refrigeration appliances is that it is more difficult to store and retrieve perishables or other contents from them than from upright refrigeration appliances. Furthermore, upright appliances require less floor space than chest-type refrigeration appliances of the same storage capacity, and thus are preferred in most applications where floor space is at a premium.

One possible solution to the cold air spillage problem of upright refrigerators and freezers is described in U.S. Pat. No. 3,241,899 of W. R. Donker which discloses a flexible curtain of material that can be stretched across the access opening of a refrigeration appliance. A limitation of Donker's invention is that it is meant to be used only at night when frequent access to the contents stored within the appliance is not anticipated. As such, the curtain is not readily removable and replaceable many times during a day, as would be the case with a home refrigerator or freezer.

T. Chovanec discloses in U.S. Pat. No. 2,610,473 an energy saving refrigerator display cabinet including a cylindrical body portion surrounding a series of spaced apart, rotatable shelves. The body portion of the refrigerator is equipped with a door which allows access to particular ones of the shelves after a refrigerated item is rotated into position in front of the door.

Apparent problems with Chovanec's invention include that it is mechanically quite complex and furthermore appears to be relatively inconvenient to use. The necessity for a motor to rotate the shelves so that refrigerated items are positioned in front of the door adds to the expense of the appliance and the fact that the shelves rotate would tend to introduce spillage problems.

There are numerous inventions found in the prior art for closing off portions of an upright refrigerator with the intention of inhibiting cold air spillage including those inventions disclosed in U.S. Pat. Nos. 1,630,160; 1,698,509; 1,748,670; 2,062,856; 2,124,857; 2,127,379; 2,266,857; 2,304,465; 2,381,598; 2,614,021 and 2,676,864. All of the above mentioned devices are relatively complex and therefore costly and prone to mechanical failure.

SUMMARY OF THE INVENTION

In view of the above discussion, it should be apparent that a major objective of this invention is to provide a device for preventing cold air from flowing out of an upright refrigeration appliance whenever the outer door of the appliance is opened so as to reduce the energy requirements of the refrigeration appliance.

Another objective of this invention is to provide such a device that can be manufactured inexpensively so as to become an attractive retrofit item for existing refrigeration appliances.

Yet a further objective of this invention is to provide such a device as described above which is also operative to inhibit moisture loss from the refrigerator to lengthen the useful lifetime of the moist perishables stored therein.

Briefly, the invention comprises an inner door device for a refrigeration appliance that includes a rectangular panel member that is pivotally supported between the inner walls of the refrigeration appliance so that it can rotate between a first position where it substantially closes the volume of space between a pair of shelves within the refrigeration appliance and another position where it is out of the way so that items stored upon the lower shelf of the pair of shelves can be easily reached. The inner door is also preferably provided with a latch to retain the panel in the first or closed position and at least one knob to facilitate in the opening and closing of the panel. The panel of the inner door device is preferably constructed from a clear, plastic material so that items stored upon the lower shelf of the pair of shelves are clearly visible even when the panel of the device is closed.

An advantage of the present invention is that the inner door device prevents the cold air that is within the volume of space between a pair of shelves from spilling out as soon as the outer door of the refrigerator is opened.

A further advantage of this invention is that the inner door device can inhibit moisture loss from the volume of space between a pair of refrigerator shelves and thus prolong the life of any moist perishables stored upon the lower shelf.

These and other objects and advantages of the present invention will no doubt become apparent to those skilled in the art after having read the following detailed description as accompanied by the several figures of the drawing.

IN THE DRAWING

Figure 2:
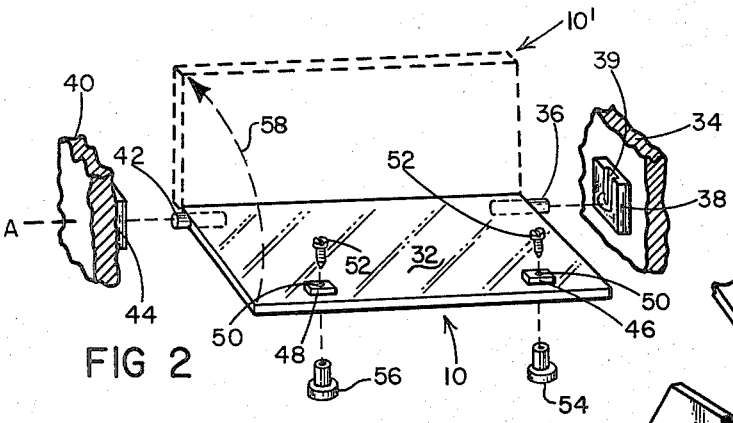
FIG. 2 is a partially exploded perspective view of an inner door device shown in FIG. 1.
Figure 2A:
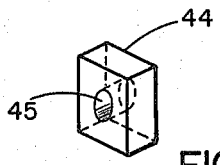
Figure 2B:
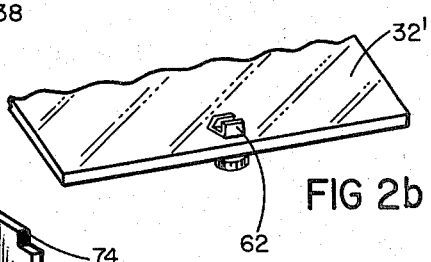
Figure 3:
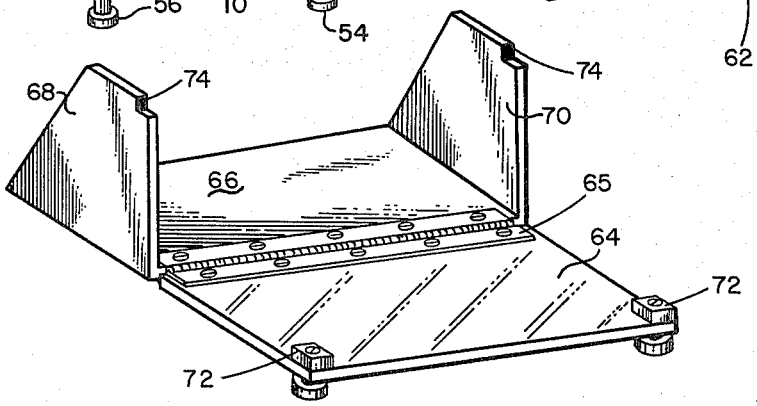

FIG. 2*a* is a perspective view of the pivot block 44 shown in FIG. 2;

FIG. 2*b* is a perspective detail view of an alternate embodiment for the magnetic latch shown in FIG. 2; and FIG. 3 is a perspective view of an alternate embodiment for an inner door device in accordance with the present invention.

DESCRIPTION OF THE PREFERRED EMBODIMENTS

Figure 1:
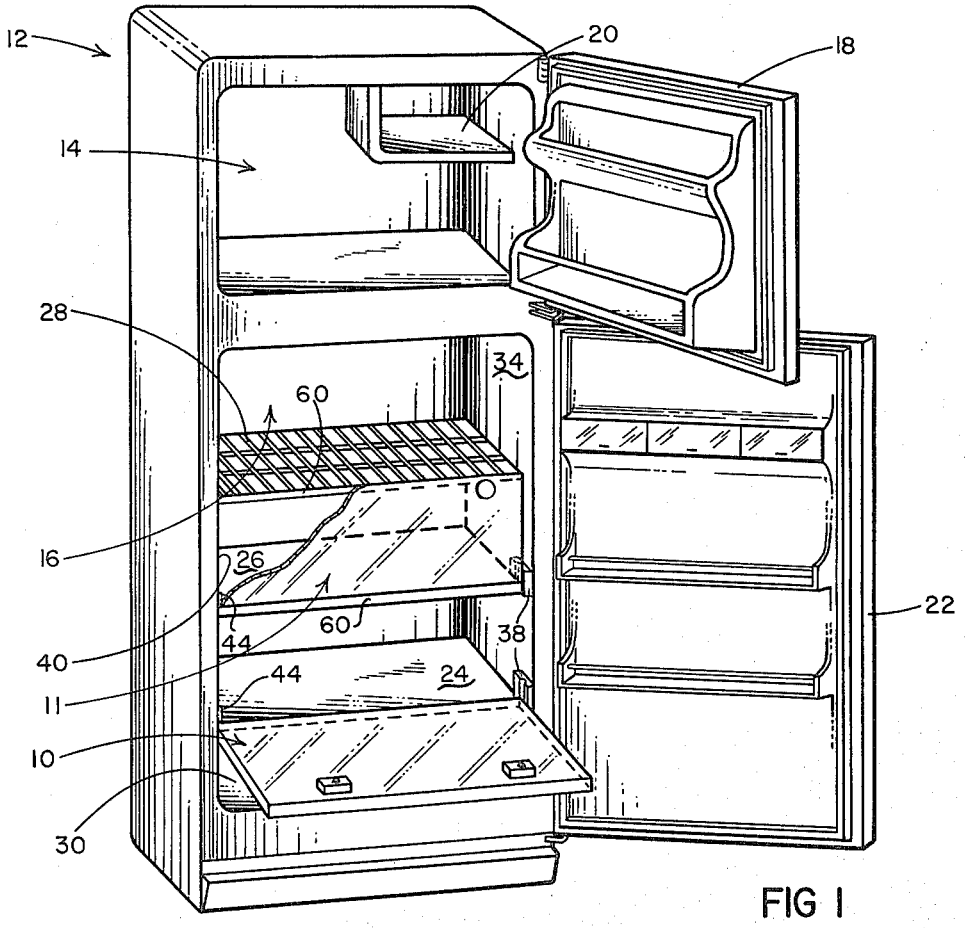
FIG. 1 is a perspective view of a refrigerator and of two inner door devices in accordance with the present invention.

In FIG. 1, two separate inner door devices 10 and 11 are shown to be installed within an upright refrigerator 12 which includes a freezer section 14 and a refrigerated section 16. The freezer section is provided with an outer door 18 and an ice cube shelf 20, while refrigerated section 16 is provided with an outer door 22 and three shelves 24, 26 and 28. Partially seen beneath shelf 24 is a vegetable crisper 30.

It will be noted that the model of refrigerator illustrated in FIG. 1 has two types of shelves, namely, solid plastic shelves 24 and 26 and a metal, open-grid shelf 28. This mixing of refrigerator shelf types is for the purpose of illustration only, however, because most refrigerators and freezers either have all solid shelves or all open-grid shelves, with the exception of the bottom shelf 24 which is most usually solid. As will be explained subsequently, the present invention is suitable for use with refrigerators and freezers having either solid or open-grid shelves, or both.

Referring now to FIG. 2 in addition to FIG. 1, an inner door device 10 includes a flat, rectangular panel 32 which is pivotally attached to an inner side wall 34 of the refrigerator by the combination of a pivot pin 36 and a pivot block 38, and which is pivotally attached to an inner side wall 40 of the refrigerator by the combination of a pivot pin 42 and a pivot block 44. The panel of inner door device 11 is attached to the inner walls of the refrigerator in the same way, as is indicated by like numerals for the pivot blocks and pins.

The pivot pins 36 and 42 are aligned along an axis "A" to allow the panel to pivot between the substantially vertical and substantially horizontal positions shown in FIG. 2 at 10' and 10. The pivot pins are preferably attached to the panel by forming bores into the side edges of the panel and press fitting or gluing the pins into the bores.

Block 38, in this preferred embodiment, has a "J" shaped groove 39 formed inwardly from a flat, outer surface with which the end of pivot pin 36 can engage. As seen in FIG. 2*a*, block 44 has a bore 45 in which pin 42 can be disposed. The J shaped groove in block 38 allows pivot pin 36 to easily disengage from the block so that the panel can be removed from the refrigerator but still, under normal conditions, securely holds the pin in a pivotal manner to allow the panel to freely rotate. Blocks 38 and 44 are preferably attached to the side wall portions of the refrigerator by a suitable cold temperature adhesive.

Seen positioned proximate a longer side edge of panel 32 are a pair of magnets 46 and 48. Each of the magnets are provided with an aperture 50 through which a bolt or screw 52 is disposed. Screws 52 further have their shanks disposed through bores formed through the panel to engage with ends of a pair of knobs 54 and 56. The knobs facilitate the movement of the panel between and upright (closed) and a non-upright (open) position. The magnets form part of a magnetic latch which holds the panel in the upright position.

To assemble the inner door device of the present invention, the pair of blocks 38 and 44 are adhesively fastened to the side wall of a refrigerator or freezer proximate to the forward edge of a lower shelf of a pair of shelves. The pivot pins of the device are then disposed within the apertures of the blocks. When thus assembled, the panel of the inner door device may freely rotate upwardly and downwardly as shown by arrow 58 in FIG. 2. In FIG. 1, inner door device 10 is shown in the open position and inner door device 11 is shown in the closed position. Magnets 46 and 48 cooperate with the magnetizable metal edges 60 found on the forward edge of the shelves of most refrigerators to create a magnetic latch for holding the panel in the upright position.

When the panel of my device is in an upright position, cold air within the volume of space between the pair of shelves it spans is substantially completely prevented from "spilling" out of the refrigerator when outer door 22 of the refrigerator is opened. The device of the preferred embodiment works almost as well between a solid lower shelf and an open-grid upper shelf as between two solid shelves because, as mentioned earlier, cold air has a tendency to settle and will not naturally flow out of the open top of a box-like enclosure. Furthermore, if my device extends between two solid shelves, it is operative to prevent moisture from escaping from between the shelves and thus preserves the moist perishables stored on the lower shelf in a better state.

It will also be noted that if a plurality of inner door devices of the preferred embodiment were used in conjunction with a refrigeration appliance having only open-grid shelves, substantial amounts of cold air could still be saved. This is because only cold air from the volume of space that was closed by the inner door device that was just opened and the air above it would flow out of the refrigerator. Thus if an inner door device spanning a pair of upper shelves were opened, very little cold air would be lost. However, as will be discussed with reference to FIG. 3, an alternative embodiment of the present invention is even better at preserving cold air within refrigeration appliances having open-grid shelves.

Referring now to FIG. 2*b*, a clip 62 is shown to be attached to a panel 32' in the stead of the pair of magnets 46 and 48. Clip 62 can removably engage the outer edge 60 of the upper shelf of a pair of shelves to hold the panel in the upright or closed position. The clip is particularly well suited for refrigerators and freezers which have shelves with non-ferrous forward edges that cannot attract a permanent magnet.

In FIG. 3, an alternate embodiment of the present invention which is well suited for refrigerators and freezers having open-grid shelves is shown. In this embodiment, a panel 64 is attached by a hinge 65 to a base plate 66, which here has two upwardly extending side portions 68 and 70. Panel 64 can pivot between the lower position shown in this figure and an upright position where it is retained by magnetic attraction between a pair of magnets 72 and a respective pair of metal plates 74 attached to the terminal end sections of side portions 68 and 70.

When base plate 66 of the device is placed on top of an open-grid shelf, such as shelf 28 of the refrigerator shown in FIG. 1, the open-grid shelf is, in effect, converted to a solid shelf due to the fact that air can no longer flow through it. By providing the inner door device of the alternate embodiment for all of the open-grid shelves of a refrigeration appliance, cold air would be confined to the volume of space between a pair of shelves as efficiently as the inner door device of the preferred embodiment confines cold air between solid shelves.

Furthermore, the embodiment of the device shown in FIG. 3 can also be placed in the freezer portion 14 of the refrigerator to prevent cold air from spilling out when freezer door 18 is opened just, for example, to reach an ice cube tray sitting upon ice cube tray shelf 20.

The operation of the device shown in FIG. 3 is virtually identical to that of the preferred embodiment in that when panel 64 is raised, cold air is prevented from spilling out from between a pair of shelves of a refrigerator and when in a lowered position, the panel is out of the way so that items stored upon the lower one of the pair of shelves can be accessed. An advantage of the alternate embodiment of the present invention, however, is that it does not need to be fastened to the refrigerator as was the case in the device of the preferred embodiment.

While this invention has been described in terms of several preferred embodiments, it is contemplated that various alterations and modifications thereof will become apparent to those skilled in the art after having read the preceding disclosure. For instance, a panel could be hinged on one of its side edges and swing outwardly in the same direction as the refrigerator's door does, or it may be hinged near the top so that it would naturally assume a closed position, eliminating the need for a latch. Also, the panel of the present invention could take many forms, such as a thin plastic film held by a metal framework.

It is therefore intended that the following appended claims be interpreted as including all such alterations and modifications as fall within the true spirit and scope of the present invention.

What is claimed is:

1. A retrofit type energy saving inner door device for a refrigeration appliance having at least an upper and a lower shelf, the device comprising a substantially rectangular panel means, a solid, impermeable base means that can be disposed upon an upper surface of said lower shelf to substantially diminish the air flow through said lower shelf, hinge means connecting an edge of said base means to a first edge of said panel means, said hinge means permitting said panel means to be rotated between a first, closed position in which said panel means substantially extends between the front edges of said upper shelf and said lower shelf, and second, opened positions in which said panel means does not fully extend between said front edges, latch means coupled to said panel means proximate a second edge thereof opposing said first edge for releasably engaging said front edge of said upper shelf, whereby said panel means can be retained in said first position, and handle means attached to said panel means to facilitate a movement of said panel means between said first position and said second positions.

2. An energy saving inner door device as claimed in claim 1 wherein said latch means comprises a magnet means coupled to said panel means proximate said second edge thereof to provide a magnetic latch with said front edge of said upper shelf, where said front edge is unmodified in any manner.

3. An energy saving inner door device as claimed in claim 1 wherein said latch means comprises clip means coupled to said panel means proximate said second edge thereof to provide a spring-type latch with said front edge of said upper shelf, where said front edge is unmodified in any manner.

* * * * *